US007645554B2

(12) United States Patent
Kurihara et al.

(10) Patent No.: US 7,645,554 B2
(45) Date of Patent: Jan. 12, 2010

(54) ELECTROPHOTOGRAPHIC RECORDING MEDIUM AND METHOD OF FORMING IMAGE

(75) Inventors: Eizo Kurihara, Kanagawa (JP); Tsukasa Matsuda, Kanagawa (JP)

(73) Assignee: Fuji Xerox Co., Ltd., Tokyo (JP)

( * ) Notice: Subject to any disclaimer, the term of this patent is extended or adjusted under 35 U.S.C. 154(b) by 441 days.

(21) Appl. No.: 11/599,294

(22) Filed: Nov. 15, 2006

(65) Prior Publication Data

US 2007/0281138 A1 Dec. 6, 2007

(30) Foreign Application Priority Data

Jun. 6, 2006 (JP) ..... 2006-157487

(51) Int. Cl.
*G03G 13/20* (2006.01)

(52) U.S. Cl. ..... 430/124.5; 428/484.1; 428/485; 428/411.1

(58) Field of Classification Search ..... 430/124.5; 428/484.1, 485, 411.1
See application file for complete search history.

(56) References Cited

U.S. PATENT DOCUMENTS 4,148,968 A * 4/1979 Nagashima et al. ..... 428/454
5,302,439 A 4/1994 Malhotra et al. ..... 428/195

FOREIGN PATENT DOCUMENTS

| | | |
|---|---|---|
| CN | 1495547 A | 5/2004 |
| JP | A-11-160905 | 6/1999 |
| JP | A-2002-341580 | 11/2002 |
| JP | A-2004-93955 | 3/2004 |

* cited by examiner

*Primary Examiner*—Mark A Chapman
(74) *Attorney, Agent, or Firm*—Morgan, Lewis & Bockius LLP

(57) ABSTRACT

An electrophotographic recording medium including a substrate and formed on the substrate at least one image receiving layer has a thermoplastic resin, the image receiving layer containing at least one kind of unsaturated fatty acid or an unsaturated fatty acid derivative having a melting point of from about 40° C. to about 120° C.

13 Claims, 2 Drawing Sheets

ELECTROPHOTOGRAPHIC RECORDING MEDIUM AND METHOD OF FORMING IMAGE

BACKGROUND (i) Technical Field

The present invention relates to an electrophotographic recording medium that has images having uniform gloss by an electrophotographic method applied to a color copy machine or a color printer and a method of forming image.

(ii) Related Art

Conventionally, glossy papers used in electrophotography are composed of a paper substrate such as normal paper, general printing paper or coated paper, and a thermoplastic resin layer provided on the surface of the paper substrate, and in the thermoplastic resin layer a toner is embedded at a time of fixing to obtain an image with no gloss irregularity. However, with environmental concerns of recent years, it has become difficult to obtain sufficient gloss in a toner image area, due to simplification of a fixing device (energy conservation), thus developing of gloss in the toner image area has become a problem to be solved.

SUMMARY

According to an aspect of the invention, there is provided an electrophotographic recording medium including a substrate and formed on the substrate at least one image receiving layer comprising a thermoplastic resin, the image receiving layer containing at least one kind of unsaturated fatty acid or an unsaturated fatty acid derivative having a melting point of from about 40° C. to about 120° C.

BRIEF DESCRIPTION OF THE DRAWINGS

Exemplary embodiments of the present invention will be described in detail based on the following figures, wherein.

DETAILED DESCRIPTION

Figure 1:
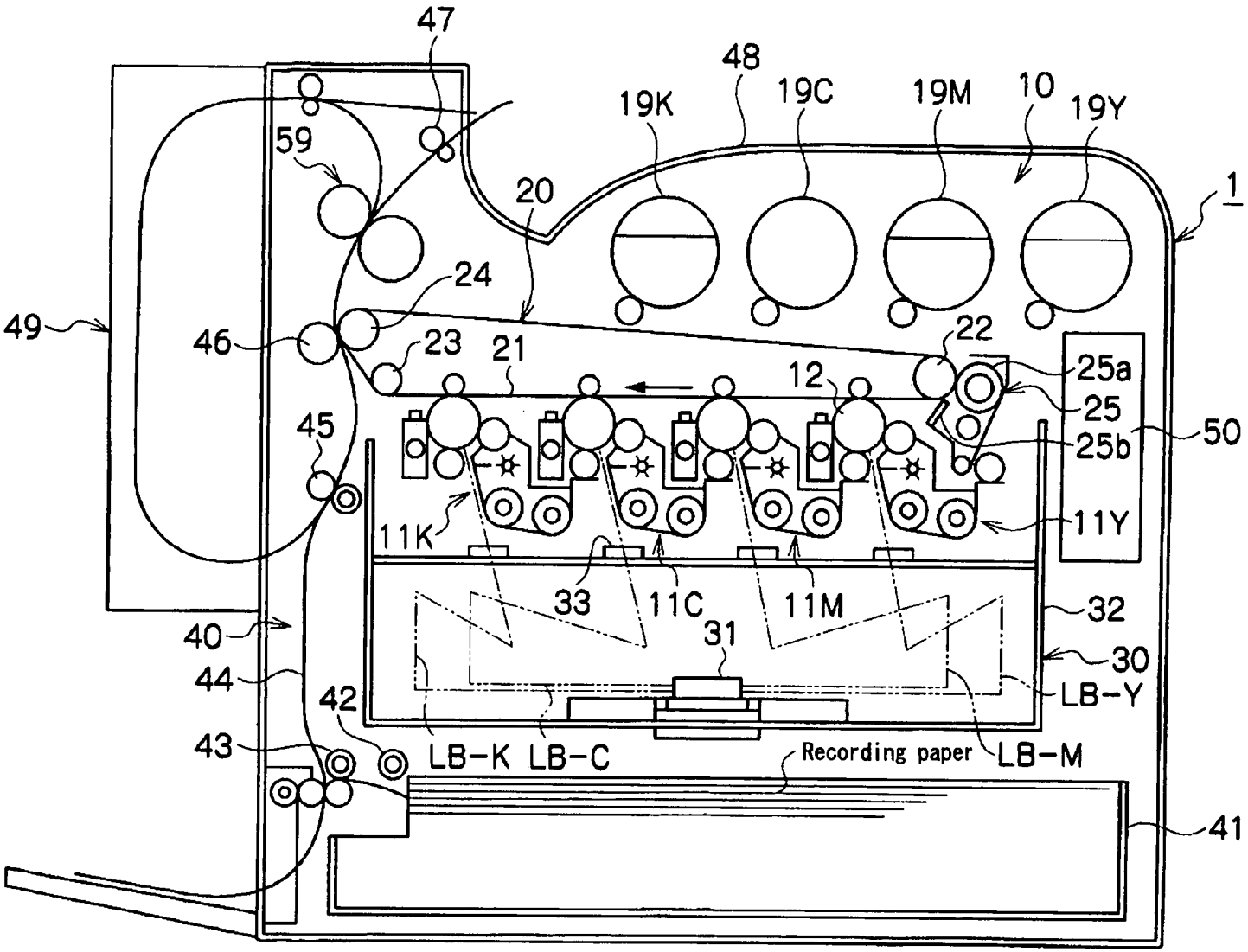
FIG. 1 is a schematic view showing a configuration of an example of an image forming apparatus that is used for an image forming method according to an exemplary embodiment of the present invention.

Hereinafter, an electrophotographic recording medium and a method of forming image according to an exemplary embodiment of the present invention will be described.

According to an aspect of the invention, an electrophotographic recording medium includes at least one image receiving layer on at least one surface of a substrate. The image receiving layer is required to contain at least one kind of unsaturated fatty acid or a derivative thereof having a melting point of 40° C. to 120° C. (hereinafter, referred to as 'unsaturated fatty acid or the like' or 'unsaturated fatty acid or a derivative thereof, in some cases). The melting point of the unsaturated fatty acid or a derivative thereof used in the invention is preferably in the range of 40° C. to 120° C., more preferably 50° C. to 100° C. If the melting point is less than 40° C., the unsaturated fatty acid or a derivative thereof may become molten, when a peripheral temperature is elevated, thus it may not endure the actual use. Further, if the melting point exceeds 120° C., it may be difficult to achieve a gloss improving effect in an image portion. Here, the image receiving layer may be a single layer containing both thermoplastic resin and unsaturated fatty acid or the like, or may be a laminate of a layer containing a thermoplastic resin and a layer containing an unsaturated fatty acid or the like.

By containing the unsaturated fatty acid or a derivative thereof in the image receiving layer, gloss in a toner image portion may be improved. Although the reason is not clear, it may be surmised that the unsaturated fatty acid or a derivatives thereof, which has become molten upon fixing, leaks out of the surface of the image receiving layer, and further leaks out of the surface of the toner image portion to form a film thereon, passing through an inter-toner gap in the toner image portion, thereby improving the gloss of the toner image portion. Therefore, the unsaturated fatty acid or a derivative thereof in the image receiving layer may have a small molecular weight, and the number of carbon atoms is preferably 10 or less. If the number of carbon atoms exceeds 10, the molecular weight may be too large to leak out of the surface of the toner image portion upon fixing, thus a gloss improving effect may be small. The number of carbon atoms is more preferably in the range of 4 to 8.

The amount of the unsaturated fatty acid of a derivative thereof to be blended in the image receiving layer is preferably in the range of 1 to less than 100 parts by weight, with respect to 100 parts by weight of thermoplastic resin as a main component of the image receiving layer. If the amount of the unsaturated fatty acid or a derivative thereof to be blended is less than 1 part by weight, reduction in viscosity of the toner upon fixing may be insufficient, thus a highly glossy image may not be obtained. If the amount to be blended exceeds 100 parts by weight, adhesiveness of the toner and the resin in the image receiving layer may be lowered, and the toner may be offset to a fixing roller upon fixing. The amount of the unsaturated fatty acid or a derivative thereof to be blended in the image receiving layer is more preferably in the range of 5 to 95 parts by weight with respect to the resin, and still more preferably in the range of 10 to 90 parts by weight with respect to resin.

Examples of the unsaturated fatty acid or a derivative thereof are not particularly limited, and include materials described in 'Great Organic Chemistry (Aliphatic Compound), published by Asakura Publishing Co., Ltd.', 'Fatty Acid Chemistry, published by Saiwaishobo Co., Ltd.', and 'Fatty Chemistry Handbook, published by Maruzen Co., Ltd.', such as olefin monocarboxylic acids, diolefin carboxylic acids, unsaturated dicarboxylic acids, or highly unsaturated monocarboxylic acids such as trienonic acids, polyenoic acids, or polyynoic acids. More specific examples include, but not limited thereto, tiglic acids, methylcrotonic acid amide, crotonic acids, elaidic acids, or behenolic acids. Two or more kinds of unsaturated fatty acids or derivatives thereof may be mixed and blended in the image receiving layer.

A temperature at which a melt viscosity of thermoplastic resin as a main component of the image receiving layer is $1\times10^4$ Pa·s is preferably 120° C. or less. If the temperature at which the melt viscosity of thermoplastic resin is $1\times10^4$ Pa·s exceeds 120° C., it may be difficult to embed the toner in the image receiving layer, and a uniform image with a high degree of gloss may not be obtained. If the melt viscosity is too low, sticking of the resin in the image receiving layer to a fixing member, called a hot offset phenomenon, may occur. Accordingly, the temperature at which the melt viscosity of thermoplastic resin is $1\times10^4$ Pa·s is preferably 50° C. or more, and more preferably 70° C. or more.

Examples of thermoplastic resin constituting the image receiving layer include polyester resins, water-soluble resins such as styrene-acrylic acid ester, styrene-methacrylic acid ester, ethylene acrylic acid copolymers, polyvinyl alcohols of various molecular weights and saponification degrees and derivatives thereof, starches, derivatives of starch (various kinds of chemically-modified starch, such as oxidized starches, cationized starches), cellulose derivatives of, for example, methoxy cellulose, carboxymethyl cellulose, methyl cellulose, ethyl cellulose and the like, polyacrylic acid sodium, polyvinyl pyrrolidone, acrylic acid amide-acrylic acid ester-methacrylic acid ester copolymers, alkali salts of styrene-maleic acid anhydride copolymers, polyacrylamide and derivatives thereof, polyethylene glycol and the like, resins of polyvinyl acetate, polyurethane, acryl-urethane copolymers, styrene-butadiene copolymers (SBR latex), acrylonitrile-butadiene copolymers (NBR latex), polyacrylic acid ester, vinyl chloride-vinyl acetate copolymers, polybutyl methacrylate, ethylene-vinyl acetate copolymers, styrene-butadiene-acrylic copolymers, polyvinylidene chloride and the like, resins having ester bonds, polyamide resins such as urea resin, polysulfone resins, polyvinyl chloride resins, polyvinylidene chloride resins, vinyl chloride-propionic acid vinyl copolymer resins, polyol resins such as polyvinyl butyral, cellulose resins such as ethyl cellulose resins and cellulose acetate resins, polycaprolactone resins, polyacrylonitrile resins, polyether resins, epoxy resins, phenol resins, polyolefin resins such as polyethylene resin, polypropylene resin or the like, copolymer resins of olefins such as ethylene or propylene and other vinyl monomers, acrylic resins, glue, casein, soy protein, gelatin, sodium alginate, and the like. Two or more of such polymers may be used in combination.

The image receiving layer may further contain pigments. Example of the pigments include, but not particularly limited to, inorganic pigments such as zinc oxide, titanium oxide, calcium carbonate, silicates, clay, talc, mica, calcined clay, aluminum hydroxide, barium sulfate, lithopone, silica and colloidal silica; organic pigments called plastic pigments of spherical hollow structure, such as polystyrene, polyethylene, polypropylene, epoxy resins, styrene-acrylic copolymers, powders of starch, or powders of cellulose. Such pigments may be used alone or in combination, if appropriate.

The application amount of the image receiving layer is preferably in the range of 2 $g/m^2$ to 40 $g/m^2$. If the application amount is less than 2 $g/m^2$, the toner may not be embedded in the image receiving layer upon fixing, and the gloss may be lowered. If the application amount exceeds 40 $g/m^2$, thermal capacity of the image receiving layer may increase, thus embedding of the toner may become insufficient. The application amount of the image receiving layer is preferably in the range of 5 $g/m^2$ to 30 $g/m^2$, and more preferably in the range of 8 $g/m^2$ to 20 $g/m^2$.

The image receiving layer may contain a releasing agent. Any releasing agent may be used insofar as it can prevent a phenomenon of the molten resin in the image receiving layer offsetting to the fixing member during the fixing process. For example, waxes, higher fatty acids, higher alcohols, higher fatty acid amides and the like may be used, but are not intended to limit the invention. Examples of the waxes include vegetable waxes such as carnauba wax and rice wax, petroleum waxes such as paraffin, microcrystalline and petrolactam, and synthetic hydrocarbon waxes such as polyethylene wax. Examples of the higher fatty acids include stearic acids, oleic acids, palmitic acids, myristic acids, lauric acids and the like. Examples of the higher alcohols include lauryl alcohol, myristyl alcohol, stearyl alcohol, cetyl alcohol, behenyl alcohol and the like. Examples of the higher fatty acid amides include stearic acid amide, palmitic acid amide, methylene bis-stearyl amide, ethylene bis-stearyl amide and the like.

The blending amount of the releasing agent is preferably 0.1% by weight to 20% by weight in the image receiving layer. If the blending amount is less than 0.1% by weight, the effect as the releasing agent may be insufficient, and, upon fixing, the recording medium may be wound around a heating roller. Further, if the blending amount exceeds 20% by weight, the amount to leak out of the surface of the image receiving layer may increase, thus a stain of the leaked releasing agent may remain on a non-image formed or image formed part after fixing.

A coating method of the image receiving layer may be selected from known methods as appropriate, such as a Mayer bar coating method, a gravure roll coating method, a roll coating method, a reverse coating method, a blade coating method, a knife coating method, an air knife coating method, an extrusion coating method, a cast coating method and the like.

The smoothness of the substrate, as defined in Japan TAPPI No. 5, is preferably 500 seconds or more. By making the smoothness of the substrate 500 seconds or more, unevenness of the surface of the substrate may be reduced, thus a uniform image receiving layer may be obtained. Higher smoothness is more preferable from the viewpoint of imparting gloss to the image, and more preferably in the range of 2000 seconds to 8000 seconds.

Examples of the substrate of the electrophotographic recording medium according to the aspect the invention may include a synthetic resin film, a sensitized paper, a synthetic paper, a medium-quality paper, a high-quality paper, a coated paper, an art paper, a cast coated paper and the like. Among them, a substrate formed from raw materials containing pulp may be used for ease of image reading. As the pulp used in the substrate, any of well-known pulps may be used, such as LBKP (broad-leaved tree bleaching kraft pulp), NBKP (needle-leaved tree bleaching kraft pulp), LBSP (broad-leaved tree bleaching sulfite pulp), NBSP (needle-leaved tree bleaching sulfite pulp), non-wood pulps such as cotton pulp, waste paper pulp, GP (ground pulp), and TMP (thermo-mechanical pulp) may be used. For a papering method, ordinary paper machines, may be appropriately used, such as a Fourdrinier paper machine, a cylinder paper machine, and a Yankee paper machine. Fillers used for these paper machines are not particularly limited, and examples thereof include inorganic fillers containing calcium carbonates such as heavy calcium carbonate, light calcium carbonate and choke, silicic acids such as kaolin, calcined clay, pyrophyllite, sericite and talc, and titanium dioxide, and organic fillers such as urea resin and styrene.

A sizing agent contained in the substrate is also not particularly limited and examples thereof include sizing agents such as rosin sizing agents, synthetic sizing agents, petroleum resin sizing agents, and a neutral sizing agent. Further, combination of an appropriate sizing agent such as aluminum sulfate or cationic starch, a fiber, and a fixing agent may be used. In addition, a paper strengthening agent, a dye, a pH adjuster, and the like may also be added.

For the purpose of adjusting electrical resistance, materials may be used alone or in combination, such as inorganic materials such as sodium chloride, potassium chloride, calcium chloride, sodium sulfate, zinc oxide, titanium dioxide, tin oxide, aluminum oxide and magnesium oxide, and organic materials such as alkyl phosphate ester salt, alkyl sulfate ester salt, sodium sulfonate salt and quaternary ammonium salt.

To perform a smoothing treatment to the substrate, a normal smoothing treatment apparatus may be used, such as a super calender, a gloss calender, a soft calender or the like. Further, the smoothing treatment may be appropriately performed in an on- or off-machine manner. In addition, a shape of a pressing apparatus, the number of pressure nips, and a heating condition may be controlled as appropriate according to normal smoothing treatment apparatuses.

When a coated paper is used as the substrate, a base paper is not particularly limited, and examples thereof include an acid paper having papering pH of about 4.5 and a neutral paper mainly containing an alkali filler such as calcium carbonate, wherein the papering pH ranges from acescence of about pH 6 to alkalescence of about pH 9. The coated paper used as the substrate has a pigment coating layer on at least one side, wherein the pigment coating layer is formed by applying a coating solution mainly composed of an adhesive and a pigment. Water-soluble and/or water-dispersible high-molecular-weight compounds may be used as an adhesive for the pigment coating layer. Examples of the water-soluble and/or water-dispersible high-molecular-weight compounds include starches such as a cationic starch, an amphoteric starch, an oxidized starch, an enzyme modified starch, a thermo-chemically modified starch, an esterified starch, and an etherified starch, cellulose derivatives such as carboxymethyl cellulose and hydroxyethylcellulose, natural or semi-synthetic high-molecular-weight compounds such as gelatin, casein, soybean protein and natural rubber, polyvinyl alcohol, polydienes such as isoprene, neoprene and polybutadiene, polyalkenes such as polybutene, polyisobutylene, polypropylene and polyethylene, vinyl polymers or copolymers such as vinyl halides, vinyl acetate, styrene, (metha) acrylic acid, (metha) acrylic acid ester, (metha) acrylic acid amide and methyl vinyl ether, synthetic rubber latexes such as styrene-butadienes and methyl methacrylate-butadienes, and synthetic high-molecular-weight compounds such as polyurethane resins, polyester resins, polyamide resins, olefin-maleic anhydride resins and melanine resins. Materials as described above may appropriately selected and used alone or in combination, according to a quality target of the electrophotographic recording medium.

The blending ratio of the adhesive is preferably in the range of 5 to 50 parts by weight, with respect to 100 parts by weight of the pigment. If the ratio is less than 5 parts by weight, a resin solution may affect the surface of the substrate when a resin layer is coated onto the pigment coating layer, and a desirable degree of white paper gloss may not be obtained. When the blending ratio exceeds 50 parts by weight, bubbles may be generated at the time of coating the pigment coating layer and the coated surface may be roughened, therefore a desirable degree of white paper gloss may not be obtained.

Examples of the pigment include mineral pigments such as heavy calcium carbonate, light calcium carbonate, kaolin, calcined kaolin, structural kaolin, delaminated kaolin, talc, calcium sulfate, barium sulfate, titanium dioxide, zinc oxide, alumina, magnesium carbonate, magnesium oxide, silica, magnesium aluminosilicate, fine-particle calcium silicate, fine-particle magnesium carbonate, fine-particle light calcium carbonate, white carbon, bentonite, zeolite, sericite and smectite, or organic pigments such as polystyrene resins, styrene-acrylic copolymer resins, urea resins, melamine resins, acrylic resins, vinylidene chloride resins and benzoguanamine resin, and micro hollow particle types or through-hole types of these organic pigments. These materials may be used alone or in combination.

In addition to the above-described pigments, in the coating solution of the pigment coating layer, various assistants may be used as appropriate, such as a detergent, a pH adjustor, a viscosity modifier, a softening agent, a gloss imparting agent, a dispersing agent, a flow modifier, a conductive inhibitor, a stabilizing agent, an antistatic agent, a cross-linking agent, an antioxidant, a sizing agent, a fluorescing brightening agent, a coloring agent, an ultraviolet absorbing agent, an anti-foaming agent, a water resistance imparting agent, a plasticizer, a lubricant, a preservative, and a perfume.

The application amount of the pigment coating layer may be determined as appropriate according to the purposes of the electrophotographic recording medium of the invention. However, such an amount as to cover the depressions and projections on the surface of the substrate is generally required, and the amount preferably ranges from 2 to 8 $g/m^2$ in terms of dry weight. Known coating apparatuses may be appropriately used for the coating method of forming the coating layer, such as a blade coater, an air-knife coater, a roller coater, a reverse roller coater, a bar coater, a curtain coater, a die coater, a gravure coater, a Champlex coater, a brush coater, a size press coater of two-roller type or metering blade type, a bill blade coater, a short dwell coater and a gate roller coater.

The pigment coating layer may be formed on one or both surfaces of the substrate. Further, if necessary, the pigment coating layer may be in the form of a single layer or a multilayer structure including at least one intermediate layer. In cases where the layers are formed on both sides or the layer has a multilayer structure, coating solutions for each layer need not to be the same kind or the same amount, and each may be blended as appropriate according to the desired quality level. In cases where the coating layer is provided on one surface of the substrate, by providing the backside of the substrate with a synthetic resin layer, a coating layer containing an adhesive, a pigment and the like, or an antistatic layer, curl generation may be prevented and properties such as printability and paper feed/discharge suitability may be imparted.

Various kinds of usage suitability may be imparted on the back surface of the substrate, by performing post-processes such as adhesion, magnetism, flame resistance, heat resistance, water resistance, oil resistance, lubrication resistance, and the like, as a matter of course. The substrate having the pigment coating layer is finished by adjusting moisture content to 3 to 10% by weight, preferably, 4 to 8% by weight, through normal processes such as a drying process and a surface treatment process.

When the smoothing treatment is performed to the substrate, a normal smoothing treatment apparatus, such as a super calender, a gloss calender, and a soft calender, may be used. Further, the smoothing treatment may be appropriately performed in an on- or off-machine manner, and the shape of a pressing apparatus, the number of pressure nips, and the heating conditions may also be appropriately controlled according to those for normal smoothing treatment apparatuses. However, when the smoothing treatment apparatus is used for the substrate of the invention, a substrate satisfying low air permeability and high smoothness may be obtained by decreasing a pressure load, lowering the air permeability by using a pigment having a large particle size in the pigment coating layer.

After coating, a sheet in a semi-dry or a dry state may be brought into contact with a heated or non-heated mirror-finished cast drum, to improve the surface smoothness of the image receiving layer.

In the electrophotographic recording medium, it is preferable to adjust the composition such that its surface electrical resistance becomes $8.0\times10^{8}\Omega$ or more at a temperature of 28° C. and a relative humidity of 85%.

Hereinafter, a method of forming image will be described in detail.

The method of forming image according to the invention is the method of forming image for using known electrophotographic processes, which utilizes the specified electrophotographic recording medium as a transferring medium. The method of forming image is not particularly limited, but it is preferable to use the method of forming image that will be described below, specifically.

That is, it is preferable to use the method of forming image including a process for forming a latent image on a latent image carrier, a process for developing the latent image by an electrophotographic developer and forming a toner image, a process for transferring the toner image onto the transferring medium, and a process to fix the transferred toner image on the transferring medium by heating. The above-mentioned method of forming image may further include other processes in addition to the above four processes, if required.

The method of forming image according to an exemplary embodiment of the invention will be described with reference to the accompanying drawings. FIG. 1 is a view showing an entire structure of the image forming apparatus according to the exemplary embodiment of the invention, which shows a tandem type digital color printer. The image forming apparatus shown in FIG. 1 is provided with, in a body 1, an image process system 10 for forming an image according to a gray-scale data of each color, a sheet conveying system 40 for conveying a recording sheet, and an image processing system (IPS) 50 that is connected, for example, to a personal computer or an image reading apparatus and conducts a predetermined imageing process relative to the received image data.

The image process system 10 includes four image forming units 11Y, 11M, 11C, and 11K of yellow (Y), magenta (M), cyan (C), and black (K) that are disposed in parallel at constant intervals in a horizontal position, a transfer unit 20 for multi-transferring the toner image of each color formed in photoreceptor drums 12 of the image forming units 11Y, 11M, 11C, and 11K onto an intermediate transferring belt 21, and a raster output scanner (ROS) 30 serving as an optical system unit that irradiates laser light onto the image forming units 11Y, 11M, 11C, and 11K. In addition, the body 1 of the image forming apparatus includes a fixing unit 59 for fixing the image on the recording sheet that has been secondarily transferred by the transfer unit 20 to the recording sheet, by means of heat and pressure. Furthermore, the body 1 of the image forming apparatus includes toner cartridges 19Y, 19M, 19C, and 19K for supplying toner of each color to the image forming units 11Y, 11M, 11C, and 11K.

The transfer unit 20 is provided with a drive roll 22 for driving an intermediate transferring belt 21 serving as an intermediate transferring body, a tension roll 23 for applying a constant tension to the intermediate transferring belt 21, a back-up roll 24 for secondary transferring of the superimposed toner image of each color onto the recording sheet, and a cleaning device 25 for removing the remaining toner or the like on the intermediate transferring belt 21. The intermediate transferring belt 21 is trained on the drive roll 22, the tension roll 23 and the back-up roll 24 at constant tension. In addition, the intermediate transferring belt 21 is driven cyclically at a predetermined speed in the direction of an arrow by the drive roll 22 that is rotatably driven by an exclusive driving motor (not shown) that is superior in constant-speed properties. For the intermediate transferring belt 21, for example, a belt material is used, whose resistance is adjusted by using belt materials (rubber or resin) that do not generate charge-up. The cleaning device 25 is provided with a cleaning brush 25*a* and a cleaning blade 25*b*, and removes the remaining toner, sheet powders or the like from the surface of the intermediate transferring belt 21 after the transfer process of the toner image is completed, thus preparing for the following image forming process.

The raster output scanner (ROS) 30 is provided with a modulator and a semiconductor laser not shown in the drawings, and a polygon miller 31 for bias scanning laser lights (LB-Y, LB-M, LB-C, LB-K) emitted from the semiconductor laser. In the example shown in FIG. 1, since the raster output scanner (ROS) 30 is disposed below the image forming units 11Y, 11M, 11C, and 11K, it may be polluted due to the fallen toner or the like. For this reason, the raster output scanner (ROS) 30 is provided with a rectangular-shaped frame 32 for sealing each constituent member and a glass window 33 provided on the frame 32 through which the laser light (LB-Y, LB-M, LB-C, LB-K) penetrates. Accordingly, the raster output scanner (ROS) 30 is configured so as to improve a scanning exposure and shield effect.

The sheet conveying system 40 includes a sheet feeding device 41 for stacking and feeding recording sheets on which the image is recorded, a nudger roll 42 for taking the recording sheet from the sheet feeding device 41 and feeding, a feed roll 43 for separating one-by-one the recording sheet fed from the nudger roll 42 and conveying, a conveying path 44 for conveying the recording sheet separated one-by-one by the feed roll 43 toward an image transferring portion. In addition, the sheet conveying system 40 further includes a registration roll 45 for timely conveying the recording sheet conveyed through the conveying path 44 toward a secondary transferring position and a secondary transferring roll 46 for secondary transferring of the image on the recording sheet by being in contact with pressure with the back-up roll 24 provided at the secondary transferring position. Furthermore, the sheet conveying system 40 further includes an ejecting roll 47 for ejecting the recording sheet on which the image is fixed by the fixing unit 59 outside the body 1, and an ejecting tray 48 for stacking the recording sheet ejected by the ejecting roll 47. In addition, the sheet conveying system 40 further includes a conveying unit for duplex printing 49 capable of recording on both sides of the recording sheet by inverting the recording sheet fixed by the fixing unit 59.

Figure 2:
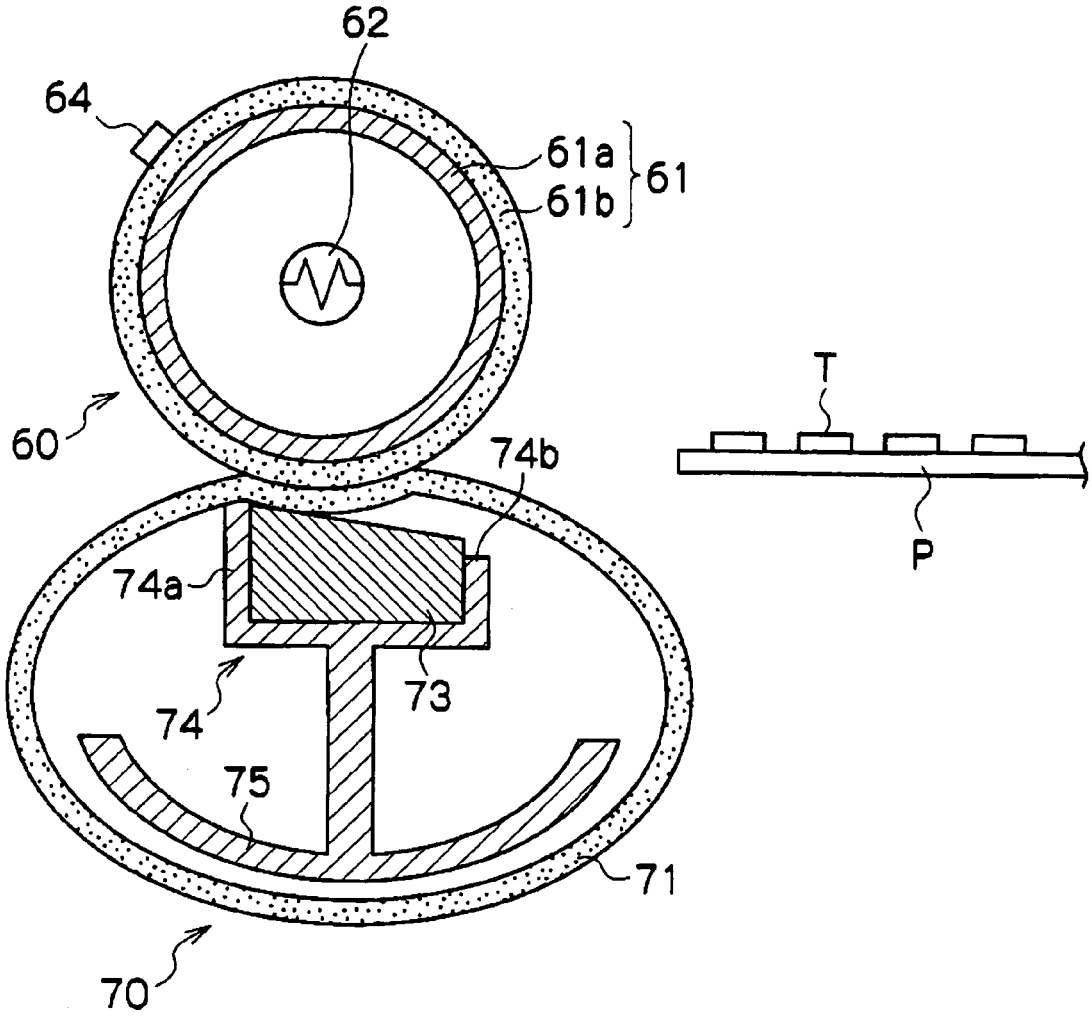
FIG. 2 is a schematic view showing a configuration of an example of a fixing device that is used for a fixing process in the image forming method according to an exemplary embodiment of the invention.

Hereinafter, it will be described the fixing unit 59 according to the exemplary embodiment of the invention. FIG. 2 is a cross-sectional view showing a schematic structure of the fixing unit 59 according to the exemplary embodiment of the invention.

In FIG. 2, the fixing unit 59 of the invention includes a heating portion 60 and a pressure portion 70. The heating portion 60 includes a fixing roll 61 capable of rotating and a heat source (heater) 62. The fixing roll 61 is composed of a cylindrical core 61*a* and an elastic layer 61*b* coating the outer periphery of the core 61. The heater 62 is inserted through the core 61*a*. Metal having high thermal conductivity such as aluminum, steel, stainless steel (SUS), copper, an alloy thereof or the like is used as a material for the cylindrical core 61*a*. The surface of the elastic layer 61*b* is composed of a material having a good heat resistance and mold-releasing properties, for example, it is preferable that the elastic layer 61*b* has an under layer of a silicone rubber or the like and a coating layer of a silicone rubber, a tetrafluoroethylene resin, or the like. Various heat sources such as a halogen lamp, infrared lamp may be used as the heater 62. In addition, a temperature sensor 64 is disposed on the heating portion 60 to measure a surface temperature of the fixing roll 61. By the measured signals of the temperature sensor 64, the heater 62 is feed-back controlled by a temperature controller not shown in the drawing, and the surface temperature of the fixing roll 61 is adjusted to a proper temperature. The surface temperature of the fixing roll 61, i.e., the fixing temperature is dependent on different kinds of toner (the character "T" shown in FIG. 2 indicates the toner) or the recording sheet (hereinafter, represented by the sheet P) to be used, but is set in the range of 120 to 200° C.

The pressure portion 70 is composed of a pressure member having an endless belt 71, an elastic member 73, a base plate 74 of the elastic member 73, or the like. The pressure member forms a nip portion between the endless belt 71 and the fixing roll 61 by pressing the endless belt 71 against the fixing roll 61, and allows the endless belt 71 to travel. As a material of the endless belt 71, the material having a good heat resistance such as a tetrafluoroethylene resin or polyimide resin may be used. In addition, when the endless belt 71 is tension-free, a tension member may be omitted, the endless belt 71 may be in no danger of being damaged, and warm-up time may be shortened. When the elastic member 73 is loaded, as described above, the elastic member 73 is directly pressed against the endless belt 71 by an elastic force thereof, not only forming a nip portion between the endless belt 71 and the fixing roll 61, but also allowing the endless belt 71 to travel. The material of the elastic member 73 is required to have elasticity and heat resistance. Examples of the material include silicone rubber or fluorine rubber, a blend rubber thereof, or the like. In order to ensure enough elasticity for sufficient fixing and downsizing of an image forming apparatus, it is preferable that the thickness of the elastic member 73 is in the range of 2 to 10 mm.

The base plate 74, which is provided in an extended manner in the direction of the axis of the fixing roll 61, mounts and fixes the elastic member 73 thereon. The base plate 74 has a trapezoidal cross-section plane with the upper side open. In the trapezoidal base plate 74, a side wall 74*a* of the exit side of the sheet P is higher than a side wall 74*b* of the entrance side, and the side wall 74*a* is chamfered in the region from the upper end thereof to the upper end of the outer surface. In addition, the upper surface of the elastic member 73 is inclined such that the elastic member is thicker in the exit side of the sheet P than in the entrance side of the sheet P. That is, when the pressure member is pressed toward the center of the fixing roll 61, the nip is formed by pressing the upper end of the side wall 74*a* into the elastic layer 61*b*, thereby improving peel properties of the sheet P during fixation. For this reason, a peeling tab is not necessarily provided at the exit side of the nip portion of the fixing roll 61.

A belt guiding member 75 is disposed at a lower end of a connecting member that is integrally formed with, and vertically extends from the base plate 74. The belt guiding member 75 is curved along the endless belt 71 so as to have an arched shape. The belt guiding member 75, although not in contact with the endless belt 71 under normal conditions, guides the endless belt 71 which travels under tension-free conditions during fixation.

The fixing process according to an exemplary embodiment of the invention may be performed by an oilless fixing. The oilless fixation process is a method in which images are fixed without applying a releasing agent such as oil on the fixing member, and is performed by using the fixing unit in which a unit for supplying the releasing agent on the surface of the fixing member is omitted from the general fixing unit of the related art. By the oilless fixation, problems may prevented, such as an oil burr or an oil stripe, which is generated due to uneven oil distribution, thus enabling obtaining of an image having uniform high gloss.

Furthermore, polyester resin, styrene-acryl resin or the like is mainly used as a toner resin component. The toner may be produced by a grinding method, polymerization method or the like.

EXAMPLES

The present invention will be described with reference to the following examples, but the invention is not construed as being limited to the examples. "Parts" and "percents (%)" in the examples denote "parts by weight" and "% by weight", respectively.

Example 1

A commercially produced coat paper (trade name: JD coat paper, manufactured by Oji Paper Co., Ltd, grammage: 157 g/m$^2$, smoothness: 500 seconds) is used as a substrate. A coating solution having the following compositions is prepared. The coating solution is coated on the coat paper by using an applicator-bar. An electric-photographic recording medium having the grammage of 168 g/m$^2$ is obtained by drying the coated paper for one minute in a hot-air drier held at 100° C.

[Preparation of Coating Solution]

Prepared by dissolving the following materials in the mixed solvent (mixing ratio: 1:1) of toluene and ethyl acetate so as to have solids of 20%.

- Thermoplastic resin: 100 parts by weight of ethylene acrylic acid copolymer (trade name: ZAIKTHENE (melt viscosity is $1\times10^4$ Pa·s at a temperature of 92° C.), manufactured by Sumitomo Seika Chemicals Co., Ltd.)
- Unsaturated aliphatic acids: 20 parts by weight of tiglic acid (melting point: 64° C., manufactured by Kanto Chemical Co., Ltd.)
- Releasing agent: 7 parts by weight of paraffin wax (trade name: HNP-10, manufactured by Nippon Seiro Co., Ltd.)

Example 2

The electrophotographic recording medium having a grammage of 168 g/m$^2$ is obtained in the same manner as Example 1 except that a commercially produced coat paper (trade name: OK TOP COAT, manufactured by Oji Paper Co., Ltd, grammage: 157 g/m$^2$, smoothness: 2500 seconds) is used as a substrate.

Example 3

The electrophotographic recording medium having a grammage of 168 g/m$^2$ is obtained in the same manner as Example 1 except that a commercially produced cast coat paper (MILLER COAT PLATINA, manufactured by Oji Paper Co., Ltd, grammage: 157 g/m$^2$, smoothness: 7000 seconds) is used as a substrate.

Example 4

The electrophotographic recording medium having the grammage of 168 g/m$^2$ is obtained in the same manner as Example 3 except that a blending amount of tiglic acid contained in the coating solution is 90 parts by weight.

Example 5

A coating solution for a first layer having a following composition is coated by 10 g/m$^2$ on the surface of the substrate used in Example 3 as a first layer. After the coated paper is dried for one minute in a hot-air drier held at 100° C., a coating solution for a second layer having a following composition is coated by 1 g/m$^2$ on the surface of the first layer. Then, the electrophotographic recording medium having a grammage of 168 g/m$^2$ is obtained by drying the coated paper for one minute in a hot-air drier held at 100° C. The composition of respective coating solutions are as follows.

[Coating Solution for First Layer]

Prepared by dissolving the following materials in the mixed solvent of toluene and ethyl acetate (mixing ratio, 1:1) so as to have a solid content of 20%.

Thermoplastic resin: 100 parts by weight of ethylene acrylic acid copolymer light (trade name: ZAIKTHENE, manufactured by Sumitomo Seika Chemicals Co., Ltd.).

[Coating Solution for Second Layer]

Prepared by dissolving the following materials in the mixed solvent of toluene and ethyl acetate (mixing ratio, 1:1) so as to have a solid content of 20%.

Unsaturated aliphatic acid: 100 parts by weight of tiglic acid (manufactured by Kanto Chemical Co., Ltd.)

Releasing agent: 12 parts by weight of polyether modified silicone oil (trade name: KF-354L, manufactured by Shin-Etsu Chemical Co., Ltd.)

Example 6

The electrophotographic recording medium having a grammage of 168 g/m is obtained in the same manner as Example 3 except that a blending amount of tiglic acid contained in the coating solution is 4 parts by weight.

Example 7

The electrophotographic recording medium having a grammage of 168 g/m$^2$ is obtained in the same manner as Example 3 except that methyl crotonic acid amide (melting point: 107° C.) is used, instead of using tiglic acid contained in the coating solution, as a derivative of the unsaturated aliphatic acids.

Example 8

The electrophotographic recording medium having a grammage of 190 g/m$^2$ is obtained in the same manner as Example 3 except that the coating amount is 33 g/m$^2$.

Example 9

The electrophotographic recording medium having a grammage of 162 g/m$^2$ is obtained in the same manner as Example 3 except that the coating amount is 5 g/m$^2$.

Example 10

The electrophotographic recording medium having a grammage of 168 g/m$^2$ is obtained in the same manner as Example 3 except that crotonic acid of the unsaturated aliphatic acid (melting point: 72° C., manufactured by Tokyo Chemical Industry Co., Ltd.) is used instead of tiglic acid contained in the coating solution.

Example 11

The electrophotographic recording medium having a grammage of 168 g/m$^2$ is obtained in the same manner as Example 3 except that elaidic acid of the unsaturated aliphatic acid (melting point: 44° C., manufactured by Tokyo Chemical Industry Co., Ltd.) is used instead of tiglic acid contained in the coating solution.

Example 12

The electrophotographic recording medium having a grammage of 168 g/m$^2$ is obtained in the same manner as Example 3 except that behenolic acid of the unsaturated aliphatic acid (melting point: 58° C., manufactured by Tokyo Chemical Industry Co., Ltd.) is used instead of tiglic acid contained in the coating solution.

Example 13

The electrophotographic recording medium having a grammage of 168 g/m$^2$ is obtained in the same manner as Example 3 except that the coating solution is changed by the following compositions.

[Preparation of Coating Solution]

Prepared by dissolving the following materials in the mixed solvent of toluene and ethyl acetate (mixing ratio, 1:1) so as to have a solid content of 20%.

Thermoplastic resin: 100 parts by weight of polyester resin (trade name: Polysizer S1015 (melt viscosity is $1\times10^4$ Pa·s at a temperature of 58° C.), manufactured by DaiNippon Ink and Chemical Co., Ltd.)

Unsaturated aliphatic acid: 20 parts by weight of crotonic acid (manufactured by Tokyo chemical industry Co., Ltd.)

Releasing agent: 8 parts by weight of polyether modified silicone oil (trade name: KF-354L, manufactured by Shin-Etsu Chemical Co., Ltd.)

Example 14

The electrophotographic recording medium having a grammage of 168 g/m$^2$ is obtained in the same manner as Example 3 except that the coating solution is changed by the following compositions.

[Preparation of Coating Solution]

Prepared by dissolving the following materials in the mixed solvent of toluene and ethyl acetate (mixing ratio, 1:1) so as to have a solid content of 20%.

Thermoplastic resin: 100 parts by weight of polyester resin (trade name: MD1930 (melt viscosity is $1\times10^4$ Pa·s at a temperature of 110° C.), manufactured by Toyobo Co., Ltd.)

Unsaturated aliphatic acid: 20 parts by weight of crotonic acid (manufactured by Tokyo Chemical Industry Co., Ltd.)

Releasing agent: 8 parts by weight of polyether modified silicone oil (trade name: KF-354L, manufactured by Shin-Etsu Chemical Co., Ltd.)

Example 15

The electrophotographic recording medium having a grammage of 168 g/m$^2$ is obtained in the same manner as Example 1 except that a commercially produced high-quality paper (trade name: OK Prince High-quality, manufactured by Oji Paper Co., Ltd, grammage: 157 g/m$^2$, smoothness: 50 seconds) is used as a substrate.

Example 16

The electrophotographic recording medium having a grammage of 168 g/m$^2$ is obtained in the same manner as Example 3 except that the coating solution is changed by the following compositions.

[Preparation of Coating Solution]

Prepared by dissolving the following materials in the mixed solvent of toluene and ethyl acetate (mixing ratio, 1:1) so as to have a solid content of 20%.

Thermoplastic resin: 100 parts by weight of category of resin (trade name: Polyester WR-905 (melt viscosity is $1\times10^4$ Pa·s at a temperature of 134° C.), manufactured by Nippon Synthetic Chemical Industry Co., Ltd.)

Unsaturated aliphatic acid: 20 parts by weight of tiglic acid (melting point: 64° C., manufactured by Kanto Chemical Co., Ltd.)

Releasing agent: 7 parts by weight of paraffin wax (trade name: HNP-10, manufactured by Nippon Seiro Co., Ltd.)

Comparative Example 1

The electrophotographic recording medium having a grammage of 168 g/m$^2$ is obtained in the same manner as Example 3 except that the unsaturated aliphatic acid is not blended.

Comparative Example 2

The electrophotographic recording medium having a grammage of 168 g/m$^2$ is obtained in the same manner as Example 3 except that 10-undecenoic acid of the unsaturated aliphatic acid (melting point: 22° C., manufactured by Wako Pure Chemical Industries, Ltd.) is used instead of tiglic acid contained in the coating solution.

Comparative Example 3

The electric-photographic recording medium having a grammage of 168 g/m$^2$ is obtained in the same manner as Example 3 except that 2,4-hexa-dienoic acid of the unsaturated aliphatic acid (melting point: 133° C., manufactured by Wako Pure Chemical Industries, Ltd.) is used instead of tiglic acid contained in the coating solution.

(Method of Evaluating Quality)

Each evaluation result of the obtained electrophotographic recording medium is shown in Table 1. Measurement methods for these evaluations are as follows.

[Method of Measuring Grammage]

The grammage is measured by a method according to JIS P 8124, which is incorporated herein by reference.

[Method of Measuring Coating Amount]

Coating amount is calculated from the difference between the grammage before coating and the grammage after coating by a method according to JIS P 8124.

[Method of Measuring Smoothness]

Smoothness is measured by using a smoothness measuring instrument (type name: EY-5, manufactured by Asahi Seiko Co., Ltd.) by a method stipulated by Japan TAPPI No. 5, which is incorporated herein by reference.

[Method of Measuring Melting Viscosity of Thermoplastic Resin]

A flow tester (trade name: CFT-500, manufactured by Shimadzu Corporation) is used for measuring the melt viscosity of the thermoplastic resin used in an image receiving layer. The melt viscosity of the thermoplastic resin is measured by making a cylindrical shape an absolute dry sample of 1.2 g as a sampler under following conditions, that is, a diameter of a die (nozzle): 0.5 mm, a thickness thereof: 1.0 mm, an extruding load: 10 kgf/cm$^2$, a cross sectional area of a plunger: 1.0 cm$^2$, an initial setting temperature: 50° C., a pre-heat time: 300 seconds, and a rate of temperature rise: 3° C./min. The thermoplastic resin is gradually heated to start outflowing. As the temperature is further raised, the melted toner largely outflows, then descent of the plunger stops to finish outflowing. An apparent viscosity η' (Pa·s) is obtained by measuring the outflow amount at from 50 to 150° C., every 3° C. In this process, a temperature at which the apparent viscosity η' (Pa·s) is $1\times10^4$ Pa·s is calculated. The softening point in Table 1 is the temperature at which the apparent viscosity η' (Pa·s) is $1\times10^4$ Pa·s.

[Method of Measuring Melting Points of Unsaturated Aliphatic Acid and Derivative Thereof]

The melting points of the unsaturated aliphatic acids and the derivatives are measured by a differential scanning calorimeter (trade name: EXSTAR6000 DSC, manufactured by Seiko Instrument Co.). Measurement of the melting point is performed by precisely weighing a measuring sample of 10 mg, using alumina as a reference, and raising a temperature from 0° C. to 150° C. at the rate of 10° C./min. A peak temperature of melting is referred to as a melting point. In particular, when plural peaks of melting appear, the lowest peak is referred to as the melting point.

[Method of Measuring Glossiness]

The glossiness is measured at an image portion after fixation by a gloss measuring instrument (GM-26D type, manufactured by Murakami Color Research Laboratory) according to the method stipulated in JIS Z 8741, which is incorporated herein by reference, under the condition that an incident angle and a light received angle are 60 degrees.

[Evaluation of Uniformity Gloss in Image Portion]

The image is output by DocuColor250CP (manufactured by Fuji Xerox Co., Ltd.) and DocuCentreColor f450 (manufactured by Fuji Xerox Co., Ltd.), in Cardboard 2 mode as the fixing condition. The obtained electrophotographic recording medium is estimated by the image. DocuColor1250CP is an image forming apparatus having a fixing process in which a releasing agent is applied onto the surface of the fixing member, and DocuCentreColor f450 is an image forming apparatus having a fixing process in which a releasing agent is not applied onto the surface of the fixing member.

The used image is a color chart (S7) of a high-definition color digital standard image data (based on ISO/JIS-SCID JIS X 9201-1995, published by Japanese Standards Association Foundation). The glossiness in the image portion of the output image sample is measured and confirmed. In addition, A gloss in the image portion is calculated and confirmed. The Δ gloss is represented by the following formula.

Formula: Δ gloss (%) in the image portion=maximum glossiness in the image portion (Max, %)−minimum glossiness in the image portion (Min, %).

The glossiness in the obtained image portion, the Δ gloss, and the influences on the image portion due to the releasing agent are estimated according to the following criteria.

—Evaluation of Glossiness of Image Portion—

In the following criteria, acceptable levels are determined as A, B, and C.

A: Minimum glossiness in the image portion is 80% or more.

B: Minimum glossiness in the image portion is 70% or more and less than 80%.

C: Minimum glossiness in the image portion is 60% or more and less than 70%.

D: Minimum glossiness in the image portion is less than 60%.

—Evaluation of Δ Gloss—

In the following criteria, acceptable levels are determined as A, B, and C.

A: Δ gloss value is 5% or less.

B: Δ gloss value is greater than 5% and 10% or less.

C: Δ gloss value is greater than 10% and 20% or less.

D: Δ gloss value is greater than 20%.

—Influences on Image Portion due to Releasing Agent—

In the following criteria, acceptable levels are determined as A, B, and C.

A: No unevenness or stripe in gloss is generated due to the releasing agent of the fixing member.

B: Unevenness or stripe in gloss due to the releasing agent of the fixing member is slightly observed.

C: Unevenness or stripe in gloss due to the releasing agent of the fixing member is partially observed.

D: Unevenness or stripe in gloss due to the releasing agent of the fixing member is observed on the entire image area.

TABLE 1

| | Substrate | | | Image receiving layer | | | | | | | |
|---|---|---|---|---|---|---|---|---|---|---|---|
| | | | | Thermoplastic resin | | Unsaturated fatty acid or derivative thereof | | | | | |
| | Type | Grammage (g/m$^2$) | Smoothness (second) | Type | Melting point (° C.) | Type | Melting point (° C.) | Number of carbon atoms | Blending amount (100 parts by weight to resin) | Blending method | Application amount (g/m$^2$) |
| Example 1 | JD COAT | 157 | 500 | ZAIKTHENE | 92 | Tiglic acid | 64 | 5 | 20 | Mixing | 11 |
| Example 2 | OK TOPCOAT | 157 | 2500 | ZAIKTHENE | 92 | Tiglic acid | 64 | 5 | 20 | Mixing | 11 |
| Example 3 | MILLER COAT | 157 | 7000 | ZAIKTHENE | 92 | Tiglic acid | 64 | 5 | 20 | Mixing | 11 |
| Example 4 | MILLER COAT | 157 | 7000 | ZAIKTHENE | 92 | Tiglic acid | 64 | 5 | 90 | Mixing | 11 |
| Example 5 | MILLER COAT | 157 | 7000 | ZAIKTHENE | 92 | Tiglic acid | 64 | 5 | 10 | Application | 11 |
| Example 6 | MILLER COAT | 157 | 7000 | ZAIKTHENE | 92 | Tiglic acid | 64 | 5 | 4 | Mixing | 11 |
| Example 7 | MILLER COAT | 157 | 7000 | ZAIKTHENE | 92 | Methyl crotonic acid amide | 107 | 5 | 20 | Mixing | 11 |
| Example 8 | MILLER COAT | 157 | 7000 | ZAIKTHENE | 92 | Tiglic acid | 64 | 5 | 20 | Mixing | 33 |
| Example 9 | MILLER COAT | 157 | 7000 | ZAIKTHENE | 92 | Tiglic acid | 64 | 5 | 20 | Mixing | 5 |
| Example 10 | MILLER COAT | 157 | 7000 | ZAIKTHENE | 92 | Crotonic acid | 72 | 4 | 20 | Mixing | 11 |
| Example 11 | MILLER COAT | 157 | 7000 | ZAIKTHENE | 92 | Elaidic acid | 44 | 18 | 20 | Mixing | 11 |
| Example 12 | MILLER COAT | 157 | 7000 | ZAIKTHENE | 92 | Behenolic acid | 58 | 22 | 20 | Mixing | 11 |
| Example 13 | MILLER COAT | 157 | 7000 | POLYSIZER S1015 | 58 | Crotonic acid | 72 | 4 | 20 | Mixing | 11 |
| Example 14 | MILLER COAT | 157 | 7000 | MD1930 | 110 | Crotonic acid | 72 | 4 | 20 | Mixing | 11 |
| Example 15 | OK PRINCE | 157 | 50 | ZAIKTHENE | 92 | Tiglic acid | 64 | 5 | 20 | Mixing | 11 |
| Example 16 | MILLER COAT | 157 | 7000 | POLYESTER WR-905 | 134 | Tiglic acid | 64 | 5 | 20 | Mixing | 11 |
| Comp. Example 1 | MILLER COAT | 157 | 7000 | ZAIKTHENE | 92 | — | — | — | — | | 11 |
| Comp. Example 2 | MILLER COAT | 157 | 7000 | ZAIKTHENE | 92 | 10-undecenoic acid | 22 | 11 | 20 | Mixing | 11 |
| Comp. Example 3 | MILLER COAT | 157 | 7000 | ZAIKTHENE | 92 | 2,4-hexadienoic acid | 133 | 6 | 20 | Mixing | 11 |

| | Electrophotographic recording medium | | | | | | | | | | |
|---|---|---|---|---|---|---|---|---|---|---|---|
| | | Evaluation with Docucolor 1250CP | | | | | Evaluation with Docucolor F450 | | | | |
| | Grammage (g/m$^2$) | Glossiness of image (Max, %) | Glossiness of image (Min, %) | Glossiness of image | Δ gloss | Influences of releasing agent | Glossiness of image (Max, %) | Glossiness of image (Min, %) | Glossiness of image | Δ gloss | Influences of releasing agent |
| Example 1 | 168 | 81 | 76 | B | A | B | 80 | 75 | B | A | A |
| Example 2 | 168 | 82 | 78 | B | A | B | 82 | 78 | B | A | A |
| Example 3 | 168 | 87 | 83 | A | A | B | 86 | 82 | A | A | A |
| Example 4 | 168 | 85 | 81 | A | A | B | 85 | 81 | A | A | A |
| Example 5 | 168 | 89 | 84 | A | A | B | 88 | 83 | A | A | A |
| Example 6 | 168 | 84 | 73 | B | C | B | 80 | 69 | C | C | A |
| Example 7 | 168 | 83 | 72 | B | C | B | 81 | 70 | B | C | A |
| Example 8 | 190 | 71 | 69 | C | A | B | 68 | 66 | C | A | A |
| Example 9 | 162 | 72 | 67 | C | A | C | 69 | 64 | C | A | A |
| Example 10 | 168 | 82 | 79 | B | A | B | 83 | 80 | A | A | A |
| Example 11 | 168 | 79 | 72 | B | B | C | 75 | 68 | C | B | A |
| Example 12 | 168 | 80 | 71 | B | B | C | 76 | 67 | C | B | A |
| Example 13 | 168 | 79 | 71 | B | B | B | 78 | 70 | B | B | A |
| Example 14 | 168 | 84 | 77 | B | B | C | 80 | 73 | B | B | A |

TABLE 1-continued

| | | | | | | | | | | | |
|---|---|---|---|---|---|---|---|---|---|---|---|
| Example 15 | 168 | 71 | 68 | C | A | C | 68 | 65 | C | A | A |
| Example 16 | 168 | 69 | 67 | C | A | C | 67 | 65 | C | A | A |
| Comp. Example 1 | 168 | 82 | 75 | B | B | C | 78 | 31 | D | D | A |
| Comp. Example 2 | 168 | 81 | 74 | B | B | C | Off-set | Off-set | Off-set | Off-set | Off-set |
| Comp. Example 3 | 168 | 78 | 72 | B | B | B | 74 | 29 | D | D | A |

As will be apparent from the results shown in Table 1, by using the electrophotographic recording medium of the invention, images having uniform gloss may be obtained. Furthermore, even if the fixing unit without a releasing agent applied thereon, the images having uniform gloss may be formed. Therefore, the electrophotographic recording medium of the invention is very useful in practice.

All publications, patent applications, and technical standards mentioned in this specification are herein incorporated by reference to the same extent as if each individual publication, patent application, or technical standard was specifically and individually indicated to be incorporated by reference.

The foregoing description of the exemplary embodiments of the present invention has been provided for the purposes of illustration and description. It is not intended to be exhaustive or to limit the invention to the precise forms disclosed. Obviously, many modifications and variations will be apparent to practitioners skilled in the art. The exemplary embodiments were chosen and described in order to best explain the principles of the invention and its practical applications, thereby enabling others skilled in the art to understand the invention for various embodiments and with the various modifications as are suited to the particular use contemplated. It is intended that the scope of the invention be defined by the following claims and their equivalents.

What is claimed is:

1. An electrophotographic recording medium comprising a substrate and formed on the substrate at least one image receiving layer comprising a thermoplastic resin, the image receiving layer comprising at least one kind of unsaturated fatty acid or an unsaturated fatty acid derivative having a melting point of from about 40° C. to about 120° C., wherein the number of carbon atoms of the unsaturated fatty acid or the unsaturated fatty acid derivative is 10 or less.

2. The electrophotographic recording medium according to claim 1, wherein the melting point of the unsaturated fatty acid or the unsaturated fatty acid derivative is from about 50° C. to about 100° C.

3. The electrophotographic recording medium according to claim 1, wherein the number of carbon atoms of the unsaturated fatty acid or the unsaturated fatty acid derivative is 4 to 8.

4. The electrophotographic recording medium according to claim 1, wherein a temperature at which a melt viscosity of the thermoplastic resin is $1\times10^4$ Pas is about 120° C. or less.

5. The electrophotographic recording medium according to claim 4, wherein the temperature at which a melt viscosity of the thermoplastic resin is $1\times10^4$ Pas is about 50° C. or more.

6. The electrophotogrtaphic recording medium according to claim 4, wherein the temperature at which a melt viscosity of the thermoplastic resin is $1\times10^4$ Pas is about 70° C. or more.

7. The electrophotographic recording medium according to claim 1, wherein the smoothness of the image receiving layer side of the substrate is about 500 seconds or more.

8. The electrophotographic recording medium according to claim 7, wherein the smoothness of the image receiving layer side of the substrate is about 2000 seconds or more.

9. The electrophotographic recording medium according to claim 1, wherein the substrate is formed from raw materials comprising a pulp.

10. The electrophotographic recording medium according to claim 1, wherein the substrate comprises at least one layer comprising an adhesive and a pigment.

11. An image forming method comprising:

forming a latent image on a latent image carrier;

developing the latent image with an electrophotographic developer to form a toner image;

transferring the toner image onto the electrophotographic recording medium according to claim 1; and fixing the toner image on the electrophotographic recording medium by heating.

12. The image forming method according to claim 11, wherein the fixing is performed using a fixing member that does not have a releasing agent applied thereon.

13. The image forming method according to claim 11, wherein the fixing is performed using a fixing unit that does not have a supply unit for supplying a releasing agent.

* * * * *